United States Patent [19]

Martin

[11] Patent Number: 4,797,535

[45] Date of Patent: Jan. 10, 1989

[54] TUNGSTEN-HALOGEN HEATER

[76] Inventor: Wayne A. Martin, P.O. Box 147, West Lebanon, N.Y. 12195

[21] Appl. No.: 126,786

[22] Filed: Nov. 30, 1987

[51] Int. Cl.[4] ..... F24H 3/00; H05B 1/008

[52] U.S. Cl. ..... 219/338; 313/15; 313/22

[58] Field of Search ..... 219/354, 338, 342, 347, 219/358, 365, 382, 315, 307; 313/25, 15, 22

[56] References Cited

U.S. PATENT DOCUMENTS

| | | | |
|---|---|---|---|
| 3,906,188 | 9/1975 | Gamell | 219/338 |
| 4,055,165 | 10/1977 | Scragg et al. | 219/338 X |
| 4,233,494 | 11/1980 | Pawlik et al. | 219/382 |
| 4,289,954 | 9/1981 | Brognano et al. | 219/307 |
| 4,309,594 | 1/1982 | Jones | 219/342 X |
| 4,415,833 | 11/1983 | Oetken et al. | 313/559 |
| 4,510,375 | 4/1985 | Inskip et al. | 219/328 |
| 4,591,752 | 5/1986 | Thouret et al. | 313/25 |
| 4,593,178 | 6/1986 | Banta et al. | 219/315 |

*Primary Examiner*—E. A. Goldberg
*Assistant Examiner*—M. M. Lateef
*Attorney, Agent, or Firm*—Schmeiser, Morelle & Watts

[57] ABSTRACT

A method and apparatus for heating by use of tungsten-halogen heating elements. A space heater for use with a radiator or other heat using apparatus employs the principle of collecting heat emitted by a tungsten-halogen element by use of a heat transfer fluid, be it gaseous, liquid or liquid-emulating solids, and transferring the heat therefrom to a reservoir, other storage means or radiator. A specially devised "pancake element" is employed in the preferred embodiment so as to provide a maximum surface area for the radiation and subsequent transfer of heat, which emanates from the element, to a transfer fluid. With the exception of the disc-shaped outer envelope, the heating element of the instant invention resembles the conventional tungsten-halogen lamp. Adjunct DC power generation is acquired through use of photovoltaic cellular arrays.

10 Claims, 2 Drawing Sheets

FIG. 2
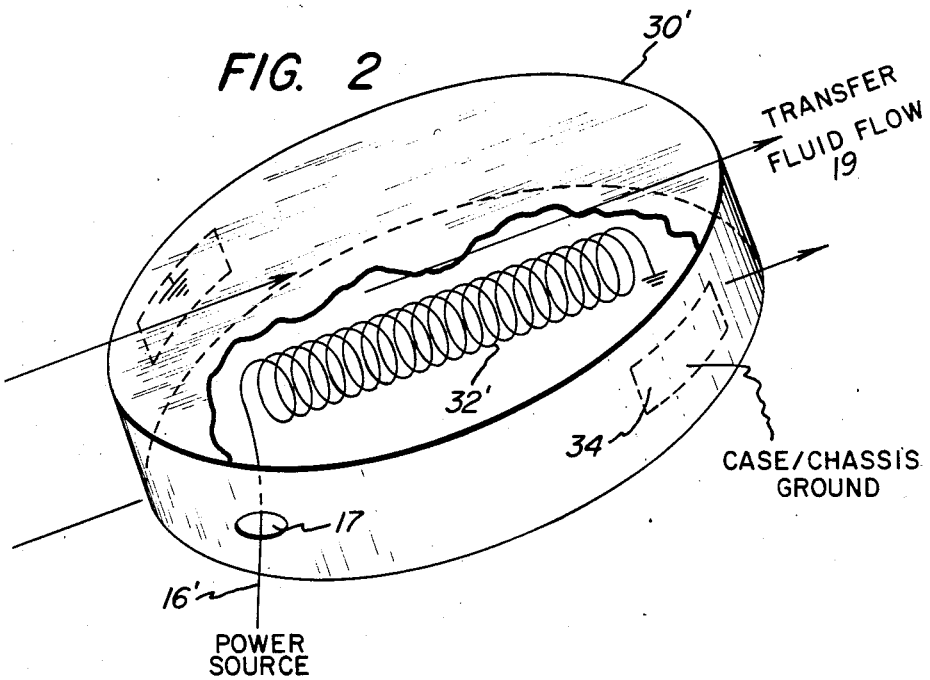
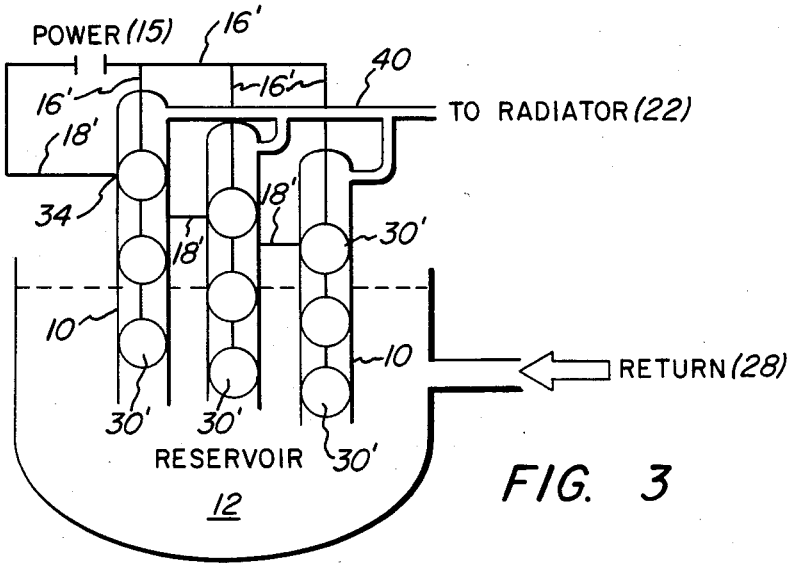
FIG. 3

TUNGSTEN-HALOGEN HEATER

FIELD OF THE INVENTION

This invention relates generally to heaters of the type conventionally employing one or more discrete heating elements. More specifically, the instant invention is a heating device which employs one or more quartz enveloped tungsten-halogen heating element lamps that are used to generate the intense heat required for effective and efficient heaters. A heat transfer fluid is employed for removing heat from the heating elements and transferring it to a radiator or a remote space for further use.

BACKGROUND OF THE INVENTION AND PRIOR ART

The quartz-halogen lamp is more properly described as a tungsten-halogen lamp, in that its basic operative mechanism for creating light is a tungsten-halogen reaction induced in tbe presence of extreme high temperatures. In typical operation, tungsten particles evaporate from the lamp filament and collide with the halogen gas particles (either iodine or bromine), resulting in a chemical (combination) formation of a halide. Proximate the filament, and at high temperatures, the halide will dissociate; thereafter, tungsten particles are deposited on the filament and the halogen gas released subsequently engages in another of the aforementioned combination. Because of the intense light and heat, a substance, oommonly quartz, is used to provide an hermetically sealed envelope about the tungsten filament, i.e., enveloping the halogen. Because the intense light of the quartz lamp is the objective of using such a device, quartz is selected for its excellent light transmission properties. It is also a material that is inert to the halide-forming reaction taking place within the lamp at such extreme temperatures (Approximately 260° C. to 370° C. at the envelope). An undesirable, if not disadvantageous, aspect of the tungsten-halogen lamp is the high heat that is radiated from the discrete device. That such heat in proximity of the lamp is a disadvantage, and moreover a disadvantage about which very little has been done, is apparent from a study of the prior art. The instant inventor has sought to use the waste heat (waste because it is undesirable), collect it, and transfer it to a place where it may be suitably used and appreciated. In his contemporaneous study of the prior art dealing with heaters, the inventor was given relative assurance that this aspect of waste heat employment has not heretofore been exploited.

Relevant patents dealing with or revealing the intense heat of the tungsten-halogen (quartz) lamp would be those similar to U.S. Pat. No. 4,415,833, issued to Oetken et al., and U.S. Pat. No. 4,591,752, issued to Thouret et al. In the former, Oetken describes the commencement of the Tungsten-Halogen reaction when the lamp envelope is sufficiently high, such is on the order of 250° C., or greater. Therein-Oetkin makes no suggestion on how to dispose of this extreme heat. Thouret, on the other hand, clearly recognizes not only the intense heat problem, but also the likelihood of envelope explosion. In order to ameliorate such a condition, Thouret developed a tungsten-halogen lamp that had an internal element with a high fill gas pressure. It is mounted within a mechanically strong transparent envelope which includes a heat conductiVe gas in the space between the element and the outer envelope. The purpose of the heat conductive gas was, however, secondary to the provision of an outer envelope to contain any elemental particles should the inner element explode. What is apparent from a reading of the Thouret patent is that inventor's purpose for providing the gas of high heat conductivity between the light producing element and the outer envelope was to immediately reduce the specific surface loading of the glass or quartz elemental envelope, so that its size might be drastically reduced. The gas filling the outer envelope was contained *static* therein; and, the character of the class of gases suggested, mandated continued containment. Thus, the heat transferring fluid (the gases) of the Thouret invention were not usable, nor could their use conceivably suggest the type of heat transferring fluid contemplated by the inventor of the instant invention.

Pawlik et al., in U.S. Pat. No. 4,233,494, suggests the use of air as a fluid in his throughflow electric heater. His heating elements are a plurality of nickel-chromium steel heating tubes that are arrayed parallel in and colinear with a heating chamber. Effectively, the Pawlik device comprises a series of thermoelectric elements that intrude directly into the airflow. Similar to the Pawlik invention, was that of Brognano et al., disclosed in U.S. Pat. No. 4,289,954. Therein, a similar electrical heating element is exposed directly to the transfer fluid, in this case water. In the Brognano invention, water is introduced to a reservoir containing the heating elements, is exposed to the heating elements and, with its temperature then elevated, is subsequently exposed to a separate coil containing water which is to be heated and removed, perhaps for potable purposes. In the Brognano invention the initial flow of water, passing over the heating elements, constitutes the actual heat transfer fluid. Other state of the art immersion heaters, for example Inskip et al., U.S. Pat. No. 4,510,375 and Banta et al., (U.S. Pat. No. 4,593,178) are later examples akin to the Pawlik and the Brognano art. Nonetheless, none of the aforesaid inventors have suggested the use of tungsten-halogen lamps, either of the quartz or alternative type, as the heating elements of an electric powered heater.

SUMMARY AND BRIEF DISCLOSURE OF THE INVENTION

The tungsten-halogen heater of the instant invention uses a quartz-halogen bulb, similar bulb or bulb-like device, employing an essentially tungsten filament and a halide enclosed in an envelope, to generate heat. This heating element is immersed in a thermally conductive medium, such as water, oil, air or flowable solid particulate (e.g., microgranular graphite), which will absorb the intensive heat radiated from within the envelope and conduct it thereafter from the envelope to a location wherein it may be placed to some use. Two variations of the preferred embodiment heating element are presented, hereinafter, which generate heat at a sufficiently high rate and at a sufficiently low cost to make the heating element feasible for several applications, including use for domestic, commercial and industrial electric hot water heaters and indirect heating devices for use in heat exchangers or for heating systems. The heating element may also be used for such indirect heating and domestic appliances such as slow cookers, crockpots, etc. Where use of quartz lamps is contemplated, photovoltaic cells are often used as adjunct power acquisition means.

BRIEF DESCRIPTION OF THE DRAWINGS

Of the drawings:

FIG. 2 is a partially sectioned isometric illustration of a "pancake" heating element; and FIG. 3 is a schematic illustration representational of the preferred embodiment with pluralistic elements.

DETAILED DESCRIPTION OF THE PREFERRED EMBODIMENT

The principle of the halogen lamp has long been known and used to primarily generate light; along with the light generated, heat and other spectral range byproducts are also produced. While heat is necessary to sustain the reaction that produces the desired light, excessive amounts of heat energy are also generated by the bulb, to the detriment of bulb operation, performance, mounting and the environment proximate the bulb. As addressed in the prior art discussion of the instant paper, many uses of the halogen bulb have required increased need for cooling and/or air-conditioning. The instant invention avoids the performance characteristics of the tungsten-halogen bulb, viz. light production, and concentrates, indeed employs, the undesirable excess heat to provide a wide range of industrial, domestic and other types of space heaters.

Figure 1A:
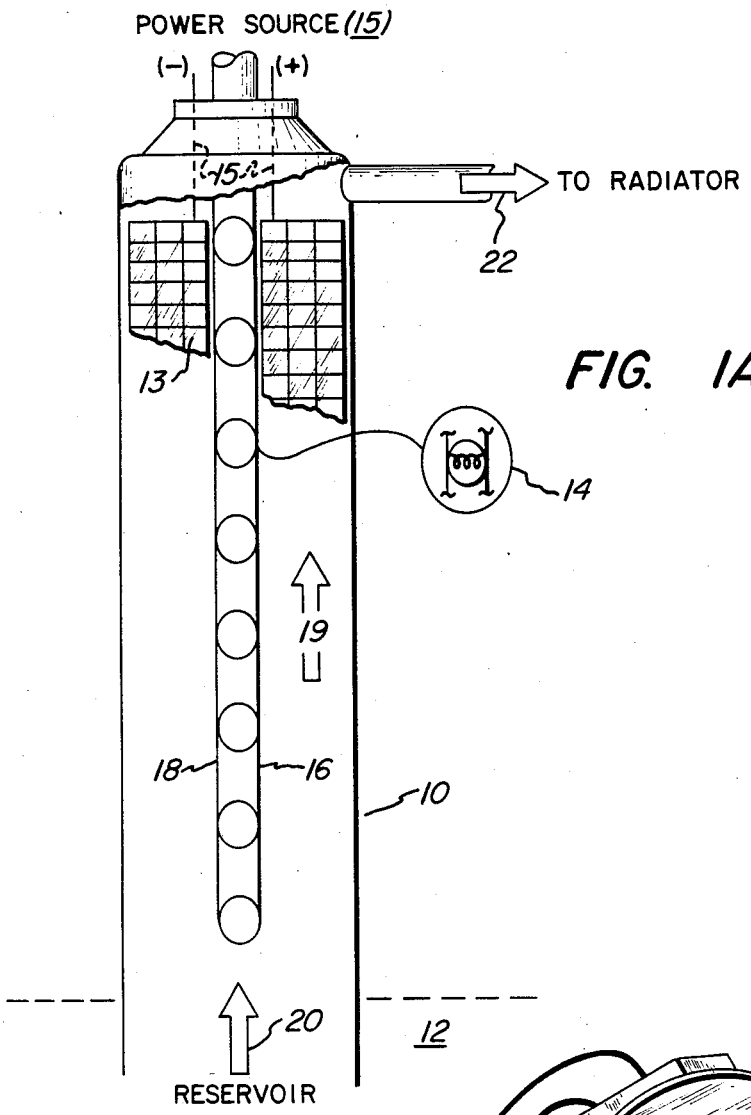
FIG. 1A is a sectioned elevational drawing of the preferred embodiment.

Referring more particularly now to FIG. 1A, a heater of the type described above is depicted in a stylized sectional drawing. Visibly evident is the conduit 10 which has the function of conducting or transmitting reservoir 12 fluid in the directions indicated by the large arrows denoting ingress 20 and egress 22. Since the invention generates large quantities of heat, those versed in the art will recognize that egressing fluid 22 may be directed back to reservoir 12, establishing a thermosiphon cycle. The basio heating element 14 comprises a tungsten-halogen device, generally described herein after as a bulb. In FIG. 1A, a series of bulbs 14 are physically and electrically arrayed within conduit 10 through use of rigid electric power leads 16, 18. The power leads are fed from the power source 15 depicted in the upper portion of the drawing. When power is provided to the array of bulbs, the intense heat generated by the lamps causes the fluid 19 to rise in conduit 10 and oommence the siphoning process. It should be understood, however, that fluid ingress 20 may be commenced by other pumping means. Presently, for example, the use of finely meshed graphite particulate, as the heat transfer fluid, would necessitate auxiliary pump means. The heated fluids will then egress 22 the heater and be taken off for use remotely, or recycled to reservoir 12, in cases where heating the particular reservoir is desired. Should the transfer fluid be clear, and the quartz bulb used, adjunct direct current power (DC) may be obtained through use of photovoltaic cellular arrays 13 attached to conduit 10 inner surface. DC power is taken off at leads 15.

Figure 1B:
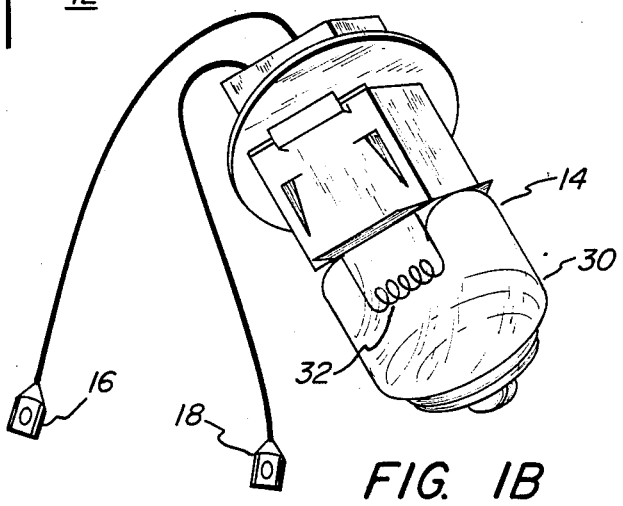
FIG. 1B is an isometric illustration of a quartz enveloped tungsten-halogen lamp.

FIG. 1B, an isometric illustration of the bulb 14, is provided in order to point out the essential elements of this light/heating device. Power leads 16, 18 are connected directly to filament 32, a coil of tungsten alloy wire. A quartz envelope 30 is provided to retain the halogen gas, generally iodine or bromine, while allowing transmission of light therethrough.

The use of the ordinary quartz type tungsten-halogen lamp is considered by the inventor an expedient. Reference to FIG. 2 discloses to the reader a tungsten-halogen heating device of the inventor's conception that is compatible with the devices of FIG. 1A and preferred in the embodiment of the instant invention. The case 30' of what is termed a "pancake element" is a hollow planar circular(disc-like) shell in that it has a defined thickness and comprises, in effect, a hollow discette. The entire case provides what is termed as chassis ground, although in FIG. 2 discrete areas 34 are denoted as ground. This distinction is made because the power source 16' is brought in through an insulated seal 17, attached thereafter to tungsten filament 32' which is in turn grounded to case 30' to effect completion of the electrical circuit that is depicted in the following FIG. 3. Flow of the transfer fluid 19 is essentially as depicted by the single barbed arrows of FIG. 2. It can readily be seen from this partial schematic representation that the "pancake element", or discette, provides a much larger surface area for the conduction of the heating element's heat to the transfer fluid 19. Larger elements are obtainable that may be multi-filamented. It is the depicted preferred embodiment, however, that allows realization of an efficient, cost-effective heater as herein revealed.

An operational embodiment of the invention is depicted schematically in FIG. 3. A plurality of conduits 10 are immersed into the reservoir 12 and connected by manifold 40 to provide continuous fluid floW egressing 22 to a radiator or other heat consuming means or, in the alternative, returning to the reservoir by inlet 28. Mounted within each of the conduits 10 is a series of heating elements 30' of the type described in FIG. 2, and above. Each element is rigidly fixed to the conduit, or common electrical line within the conduit, and to one pole of the power source 15; while the other pole 16' is parallel-connected to the array of heating conduits and their respective elements therein.

The preferred embodiment, having been described and detailed herein by the disclosure and drawings, is not intended to be restricted except by the appended claims. Practice with the invention shall imbue the user with an appreciation of the instant art. As will be readily apparent to those so skilled, the invention may be realized in alternative physical modes. Such other physical modes would be akin to any analogous heat transfer system which uses one or more discrete heating elements to impart heat to a transfer fluid such as air, water or oil. Circulation may be motivated by oonventional pumps or by the convection cycle of a thermosiphon.

What is claimed:

1. A heater comprising:

conduit means for liquidic fluid flow having defined therein fluid ingress and egress ports;

physical and electrical means within said conduit for attachment and operation of at least a singular tungsten-halogen heating element therein; and at least one tungsten-halogen heating element attached to said electrical means.

2. In an immersion heater for collecting and employing the heat generated by a tungsten-halogen heating element, the combination comprising:

at least one conduit for transmitting liquidic fluid flow therethrough and having defined therein ingress and egress ports for said fluid;

at least one compound physical and electrical mount within said conduit for attachment of at least a singular tungsten-halogen heating element therein and thereto so that said heating element will be immersed in said liquidic fluid;

at least one tunbsten-halogen heating element attached to said mount and immersed in said fluid; and a source and removal means for flowing fluid in registry respectively with said ingress and egress ports.

3. The invention of claim 2 wherein said compound physical and electrical mount further comprises an electric circuit of at least one rigid lead upon which said heating elements may be electrically attached and physically arrayed.

4. The invention of claim 3 wherein said source and removal means comprises dynamic means for the introduction of a flowing fluid to said ingress port and said fluid removal through said egress port.

5. The invention of claim 4 wherein said fluid comprises a heat conductive solid granular substance capable of emulating fluidic flow.

6. The invention of claim 2 wherein said tungsten-halogen element further comprises a hollow planar discette comprised of suitable opaque heat conducting material and having therein at least one tungsten filament and further, adapted to contain a halogen element therein.

7. A tungsten-halogen heating element comprising: a hollow planar body comprised of suitable opaque heat conducting material;

essentially tunbsten filament means physically mounted within said body and further communicating through said body by insulated sealing means; and a halogen contained within said body.

8. The invention of claim 5 wherein said filament means is grounded to the chassis of said element.

9. A method of providing space heating through utilization of heat generated by discreet tungsten-halogen heating elements comprising the steps of:

immersing at least one tungsten-halogen element in a heat-conductive liquidic fluid so as to transfer the heat generated by said element to said fluid; and transporting said heat by means of said fluid to a place remote from the locale of said immersing step whereby further use may be made of said heat.

10. The invention of claim 9 further comprising a method of acquiring adjunct power during said space heating by arraying photovoltaic means proximate a transparent heating element and further collecting the direct current generated by said photovoltaic means.

* * * * *